US006424259B1

(12) United States Patent
Gagnon

(10) Patent No.: US 6,424,259 B1
(45) Date of Patent: Jul. 23, 2002

(54) INTRUDER/ESCAPEE DETECTION SYSTEM AND METHOD USING A DISTRIBUTED ANTENNA AND AN ARRAY OF DISCRETE ANTENNAS

(75) Inventor: André Gagnon, Hull (CA)

(73) Assignee: Auratek Security Inc., Hull (CA)

( * ) Notice: Subject to any disclaimer, the term of this patent is extended or adjusted under 35 U.S.C. 154(b) by 0 days.

(21) Appl. No.: 09/891,520

(22) Filed: Jun. 27, 2001

Related U.S. Application Data

(60) Provisional application No. 60/214,473, filed on Jun. 27, 2000.

(51) Int. Cl.[7] ..... G08B 13/18

(52) U.S. Cl. ..... 340/554; 340/552; 340/553; 340/567

(58) Field of Search ..... 340/540, 541, 340/531, 533, 545.3, 551, 552, 553, 554, 567, 573.3, 573.4; 342/28, 414, 432, 27

(56) References Cited

U.S. PATENT DOCUMENTS 4,328,487 A * 5/1982 Cheal ..... 340/554
4,358,764 A * 11/1982 Cheal et al. ..... 340/554
4,536,752 A * 8/1985 Cheal et al. ..... 340/554
4,609,909 A * 9/1986 Miller et al. ..... 340/541
4,887,069 A 12/1989 Maki
4,994,789 A 2/1991 Harman
5,045,859 A * 9/1991 Yetter ..... 342/414

* cited by examiner

*Primary Examiner*—Van Trieu
(74) *Attorney, Agent, or Firm*—Thomas Adams

(57) ABSTRACT

In a detection system for detecting intruders in the vicinity of a predetermined path or line defined by a distributed antenna, for example an open transmission line, an array of discrete antennas are provided alongside the distributed antenna and within a predetermined distance therefrom. The antennas are spaced apart from each other and the distributed antenna and define a plurality of detection zones. A radio frequency transmitter is connected to one of the distributed antenna and the array of discrete antennas, and a complementary receiver is connected to the other of the distributed antenna and the array of discrete antennas. A control unit controls the transmitter, receiver and array of antennas to exchange radio frequency energy several times via the distributed antenna and selected ones of the array of antennas and to detect perturbations caused by an intruder moving adjacent the path and adjacent a particular antenna.

15 Claims, 6 Drawing Sheets

INTRUDER/ESCAPEE DETECTION SYSTEM AND METHOD USING A DISTRIBUTED ANTENNA AND AN ARRAY OF DISCRETE ANTENNAS

This application claims priority from United States Provisional patent application number 60/214,473 filed Jun. 27, 2000.

TECHNICAL FIELD

The invention relates to detection systems and methods and, in particular, to detection systems and methods which are used to detect objects or people moving in the vicinity of a predetermined path or line defined by a distributed antenna, for example an open transmission line. The invention is especially applicable to the detection of intruders or escapees.

BACKGROUND ART

Known such detection systems use at least one open transmission line, usually a leaky cable, as a distributed receiving antenna to receive a radio frequency signal transmitted from an associated antenna; or as a transmitting antenna to transmit signals for reception by a separate antenna. An intruder or escapee, or other object, moving in the vicinity of the leaky cable causes a perturbation in the coupling of continuous wave RF energy into or from the leaky cable. Detection of the perturbation indicates an intrusion or escape attempt. It will be appreciated that there is technically no distinction between an intruder traversing the path to enter a protected zone and an escapee traversing the path to leave a protected zone. For convenience, therefore, in this specification, the term "intruder" will be used to cover both.

It is desirable to determine, at least approximately, the location of the intruder along the length of the cable. U.S. Pat. No. 4,994,789 (Harman) issued Feb. 19, 1991 discloses a detection system in which several detection zones are provided by interposing phase-shifting modulators at intervals along the leaky cable. Each modulator can be shunted by a switch. A signal processor analyzes the signal received from the cable while the switch is operated so as to shunt the modulator or connect it in series with the cable sections, thereby allowing determination of the section in which the intrusion occurred. When such a system uses only two zones, it may be relatively economical. However, when such a system is expanded to many zones, the interdependence of the modulators, the complexities of switching them, and intricacies of signal analysis prohibitively increase cost and reduce reliability.

U.S. Pat. No. 4,887,069 (Maki) issued Dec. 12, 1989 discloses a detection system which uses two coaxial cables, one of them a leaky cable, extending along a perimeter of a protection zone, one coupled to a transmitter and the other to a receiver. The cables are subdivided into sections which are interconnected by oscillators and switches allowing selection of one section at a time. If a section has not been selected, the RF signal passes along its inner conductor. When a section is selected, the RF signal is switched to propagate as an external wave along the outer sheath of the cable section. Maki also discloses a system in which both of the coaxial cables are leaky cables, with zones provided by serialized switching, each zone being powered from a switched local oscillator. In either case, signal perturbations caused by an intruder are transmitted through the intervening sections to a receiver located at one end of the cable. The oscillators and switches increase complexity and reduce reliability.

In either of these known systems, the radio frequency energy from each cable section must pass through any preceding sections. Consequently, failure of an oscillator/switch, or modulator, as the case may be, especially near the receiver end of the cable, may compromise the system or even render it inoperative.

The present invention seeks to provide a detection apparatus and method with a plurality of detection zones, while eliminating or at least mitigating the aforementioned disadvantages of known detection systems.

SUMMARY OF THE INVENTION

According to one aspect of the present invention, a detection system for detecting intruders moving in the vicinity of a defined path comprises a distributed antenna, for example an open transmission line, extending along the path and an array of discrete antennas extending alongside the distributed antenna and within a predetermined distance therefrom, the antennas being spaced apart from each other and the distributed antenna and defining a plurality of detection zones, a radio frequency transmitter connected to one of the distributed antenna and the array of discrete antennas, a complementary receiver connected to the other of the distributed antenna and the array of discrete antennas, and control means for controlling the transmitter, receiver and array of antennas to exchange radio frequency energy several times via the distributed antenna and selected ones of the array of antennas and to analyze the energy received from each selected one of the array of antennas so as to detect perturbations caused by an intruder moving adjacent said path and adjacent that particular antenna.

The control means may comprise switching means for selecting each one of the array antennas individually for such energy exchange.

The control means may select the antennas in turn in such a sequence that, if the energy from a particular antenna when previously selected within a prescribed time period showed a perturbation, that antenna would be selected more frequently than those antennas which had not shown such a perturbation within said time period.

Preferably, the array of antennas are each connected to a respective one of a plurality of taps distributed along a transmission line extending alongside the distributed antenna The control means then may comprise a plurality of switching devices for connecting respective ones of the antennas to the transmission line and switch control means for controlling operation of the switching devices to select the antennas individually.

The switch control means may comprise a means for transmitting antenna addresses selectively onto the transmission line and each switching device then may comprise an address decoder for detecting the address of the associated antenna and an RF switch operable by the decoder to connect the antenna to the transmission line.

According to a second aspect of the invention, there is provided a method of operating an intrusion detection system having a distributed antenna extending along a path to be monitored and an array of discrete antennas extending alongside the distributed antenna and within a predetermined distance therefrom, the method comprising the steps of:

exchanging radio frequency energy several times between the distributed antenna and each of the array of discrete antennas, in turn, and analyzing energy received by each selected antenna to detect perturbations in the received radio frequency energy indicative of an intruder moving near the path and adjacent that antenna.

Preferably, the array antennas are selected in turn in such a sequence that, if the energy from a particular array antenna when previously selected within a prescribed time period showed a perturbation, that array antenna will be selected more frequently than those array antennas which had not shown such a perturbation within said time period.

Thus, the selection sequence may comprise alternate selection of perturbation-indicating antennas with non-perturbation indicating antennas.

Alternatively, the selection sequence may select all of the perturbation-indicating antennas after each selection of a non-perturbation-indicating antenna.

In addition to selecting a perturbation-indicating antenna for which a perturbation was previously recorded, the selection sequence may also be arranged to select one or each of the antennas adjacent thereto.

In embodiments of either aspect of the invention, the array antennas may be fastened to a fence, trees, a wall or a roof and the distributed antenna may be a leaky cable or the like buried nearby.

Preferably, each array antenna is a "small" antenna, i.e. no dimension of the antenna exceeds one tenth of the wavelength of the operating signal and the antenna has substantially no directivity.

When such a small antenna is mounted upon a fence or other generally unstable support, it may be susceptible to movement of the fence or other support. A third aspect of the invention addresses this problem by means of a series resistance of between 150 ohms and 300 ohms between the tap and the antenna element, preferably about 220 ohms.

According to a third aspect of the invention, a small radio frequency antenna suitable for mounting upon an unstable support, such as a wire fence, comprises an insulating board having first and second opposite surfaces, a conductive layer on the first surface, means for attaching the antenna to the support with the second surface opposed to the support, and a resistance means for connecting the conductive layer to a feedline, the resistance having a value between about 150 ohms and about 300 ohms.

BRIEF DESCRIPTION OF THE DRAWINGS

Further features and advantages of the invention will be apparent from the following description of preferred embodiments which are described by way of example only and with reference to the accompanying drawings, in which.

DETAILED DESCRIPTION OF PREFERRED EMBODIMENTS

Figure 1:
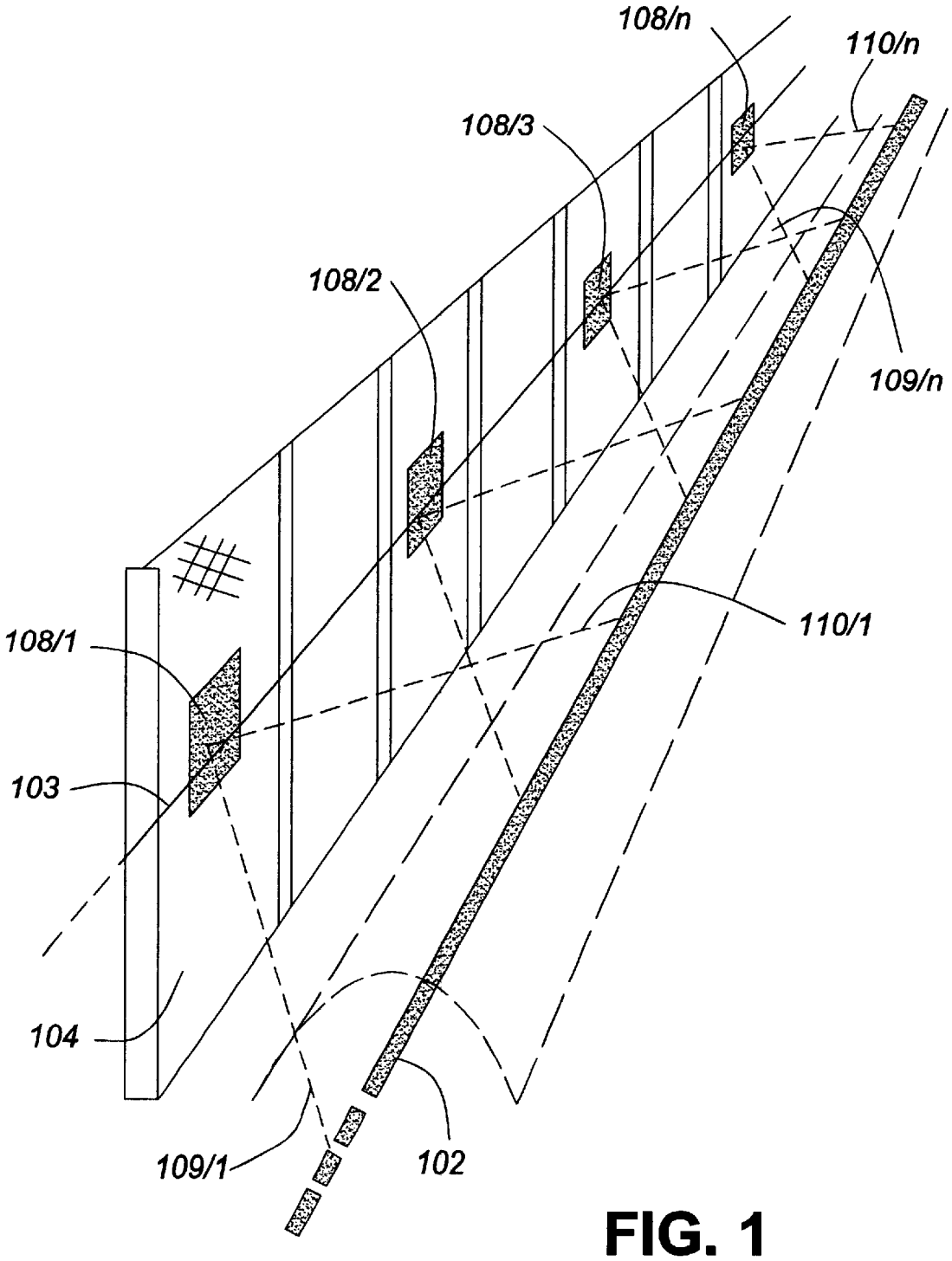
FIG. 1 is a pictorial drawing of a detection system.

For convenience of illustration, FIG. 1 illustrates only a portion, including several detection zones, of the detection system. The system comprises a leaky coaxial cable 102 or other suitable open transmission line means, either laid upon the surface of the ground or buried a short distance beneath the surface, which defines a detection path or line to be monitored. A transmission line 103, conveniently a regular coaxial cable, is shown mounted along a security fence 104 (but alternatively may be buried along the base of the fence 104). The cable 102 is depicted, for purposes of illustration only, as having a detection field 102*a* extending radially around it. It will be appreciated that, if the cable 102 is connected to a receiver, the detection field 102*a* will be induced rather than generated directly. The transmission line 103 has a plurality of taps 103/1 . . . 103/n spaced apart along its length. The taps are connected by switching devices 107/1 . . . 107/n, respectively, to a corresponding plurality of small antennas 108/1 . . . 108/n, respectively. Each tap is a T-junction allowing the switching devices to select the antennas individually for connection to the transmission line 103 without the continuity of the transmission line 103 being interrupted. The patch antennas 108/1 . . . 108/n are spaced from the cable 102 to provide a required degree of coupling therebetween while giving some room for a body to intrude into the detection zones. In operation, electromagnetic fields between the leaky cable 102 and the plurality of taps 103/1 . . . 103/n define a corresponding plurality of overlapping detection zones depicted, for purposes of illustration only, by lines 109/1; 110/1; . . . 109/n; 110/n, respectively.

In one experimental setup, the leaky cable 102 and the transmission line 103 were spaced about 20 feet apart and up to 2 miles in length with the antennas at intervals of 50 feet or so. Thus, typically, each antenna forms a perimeter sub-zone about 50 ft long, each sub-zone overlapped with its neighbouring sub-zone to obtain full coverage.

Figure 2:
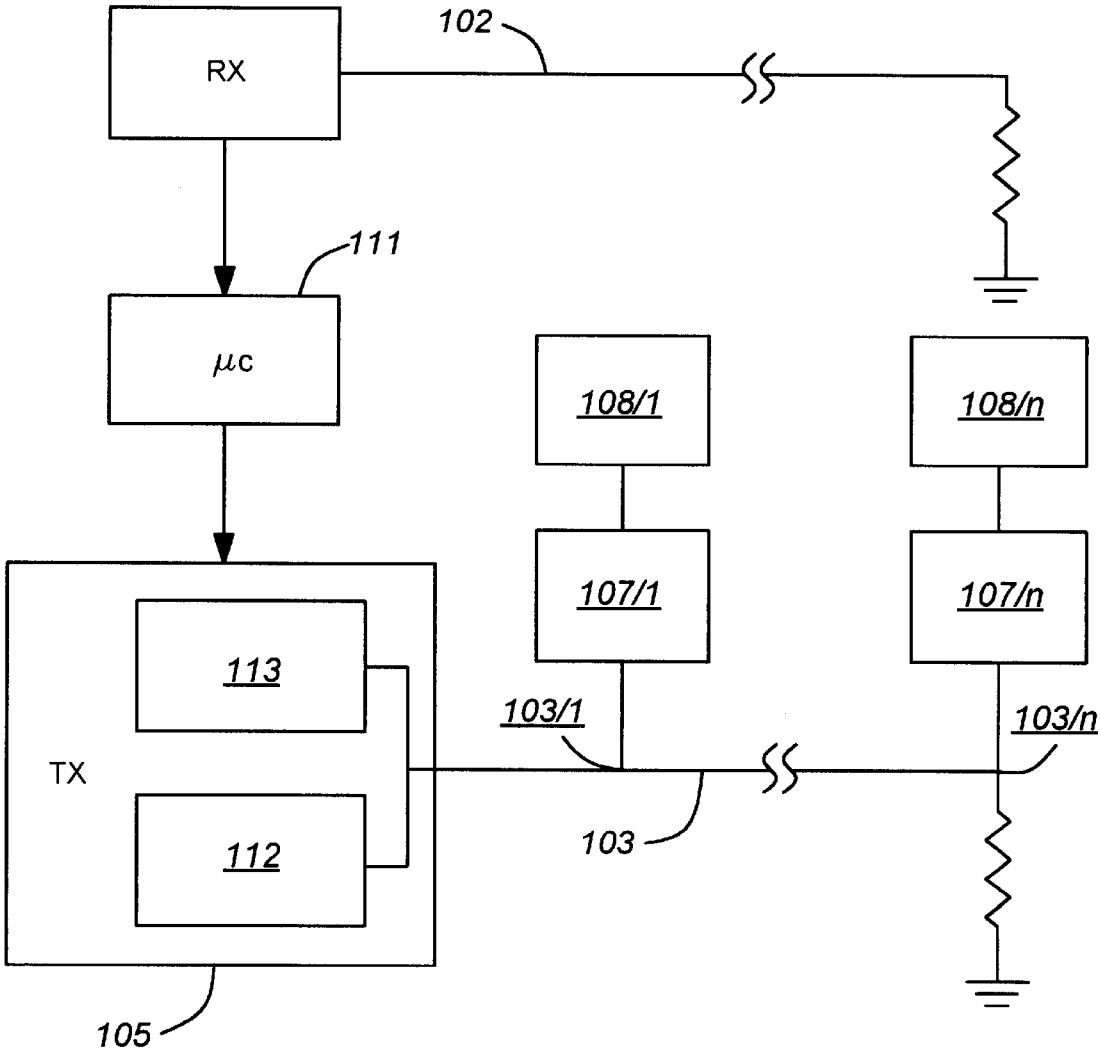
FIG. 2 is a simplified block schematic drawing of the detection system illustrated in FIG. 1.

As shown in FIG. 2, the transmitter 105 and the receiver 106 are connected to, and controlled by, a microprocessor 111. The transmitter 105, receiver 106 and processor 111 may be constructed and operate generally in a manner known to persons skilled in this art and so will not be described in detail here. For examples, the reader is directed to International patent applications numbers PCT/CA91/00050, PCTICA98/00551 and PCT/CA96/00840, which are incorporated herein by reference, The transmitter unit 105 includes a radio frequency transmitter (continuous wave source) 112 and a switch address encoder and transmitter 113 connected in common to the transmission line 103. The switch address encoder transmitter 113 relays encoded address signals, each comprising an address unique to one of the antennas produced by the processor 111, for selectively operating the switching devices 107/1 . . . 107/n and hence connecting the patch antennas to the transmission line 103 individually and sequentially. The processor 111 "scans" the patch antennas in turn, i.e., it causes the RF transmitter 112 to transmit a continuous wave radio frequency signal onto the transmission line 103 and the address transmitter 113 to transmit the address of the selected one of the antennas 108/1 . . . 108/n. The switching device associated with the selected antenna detects the address and connects the selected antenna to the transmission line 103 to receive the radio frequency signal and radiate it towards the leaky cable 102. The receiver 106 detects the corresponding radio frequency signal received by the leaky cable 102 and determines whether or not there is a perturbation indicating that an intruder has affected the electromagnetic coupling between the selected antenna and the leaky cable 102. This constitutes "scanning" or "sampling" of that antenna. How the perturbation is detected will depend upon the transmitter/receiver chosen. A simple amplitude measurement technique is preferred for its simplicity, but a "synergistic radar" technique might be used instead. If such a perturbation is detected, the microcontroller 111 records in memory (not shown) that the selected antenna is in a perturbation-indicating or "pre-alarm" condition. The microcontroller 111 will not signal an actual "intruder" alarm until a prescribed number of such "pre-alarm" conditions have been detected, as will be described later.

Figure 3:
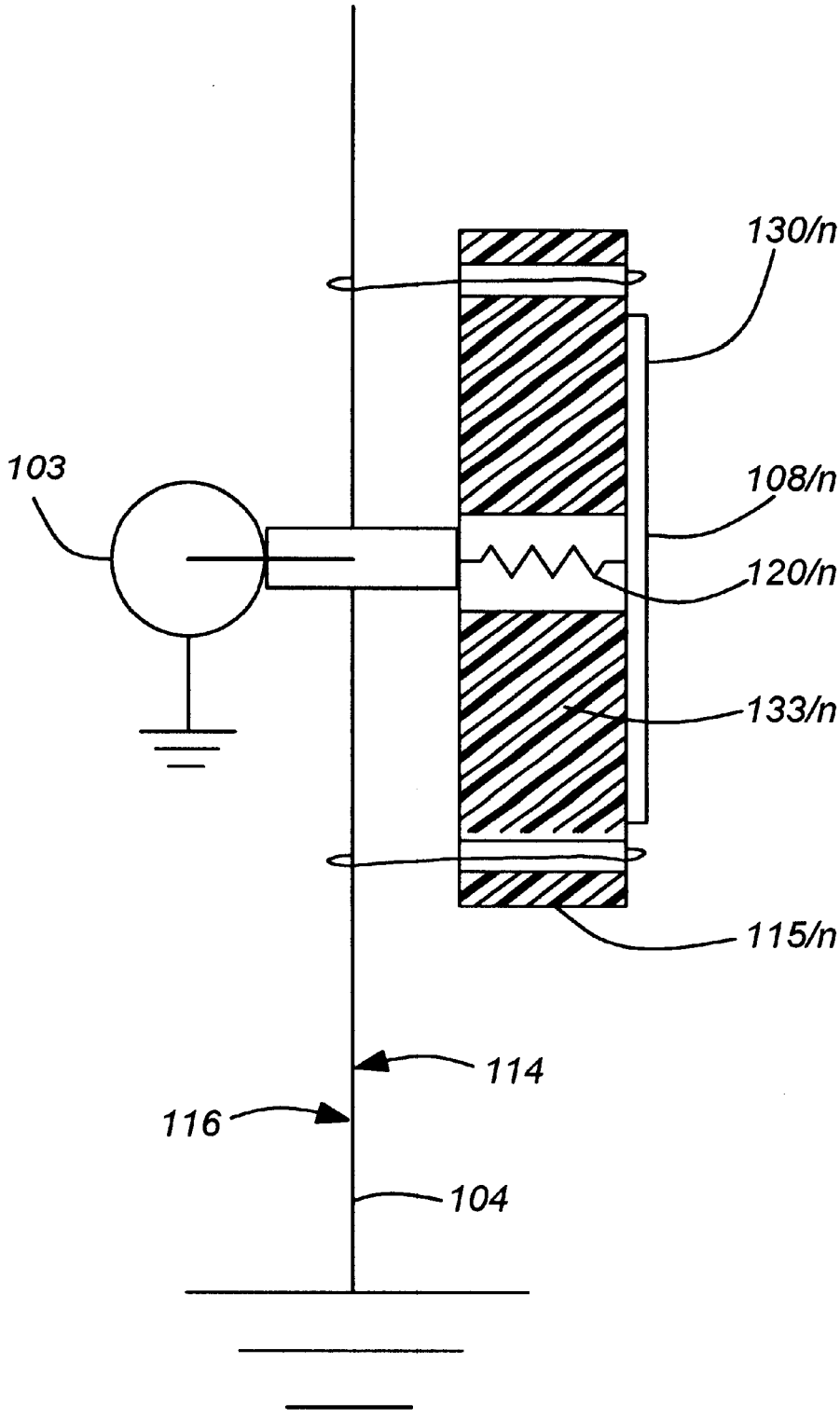
FIG. 3 is a schematic diagram of one of an array of antennas illustrated in FIGS. 1 and 2.
Figure 4:
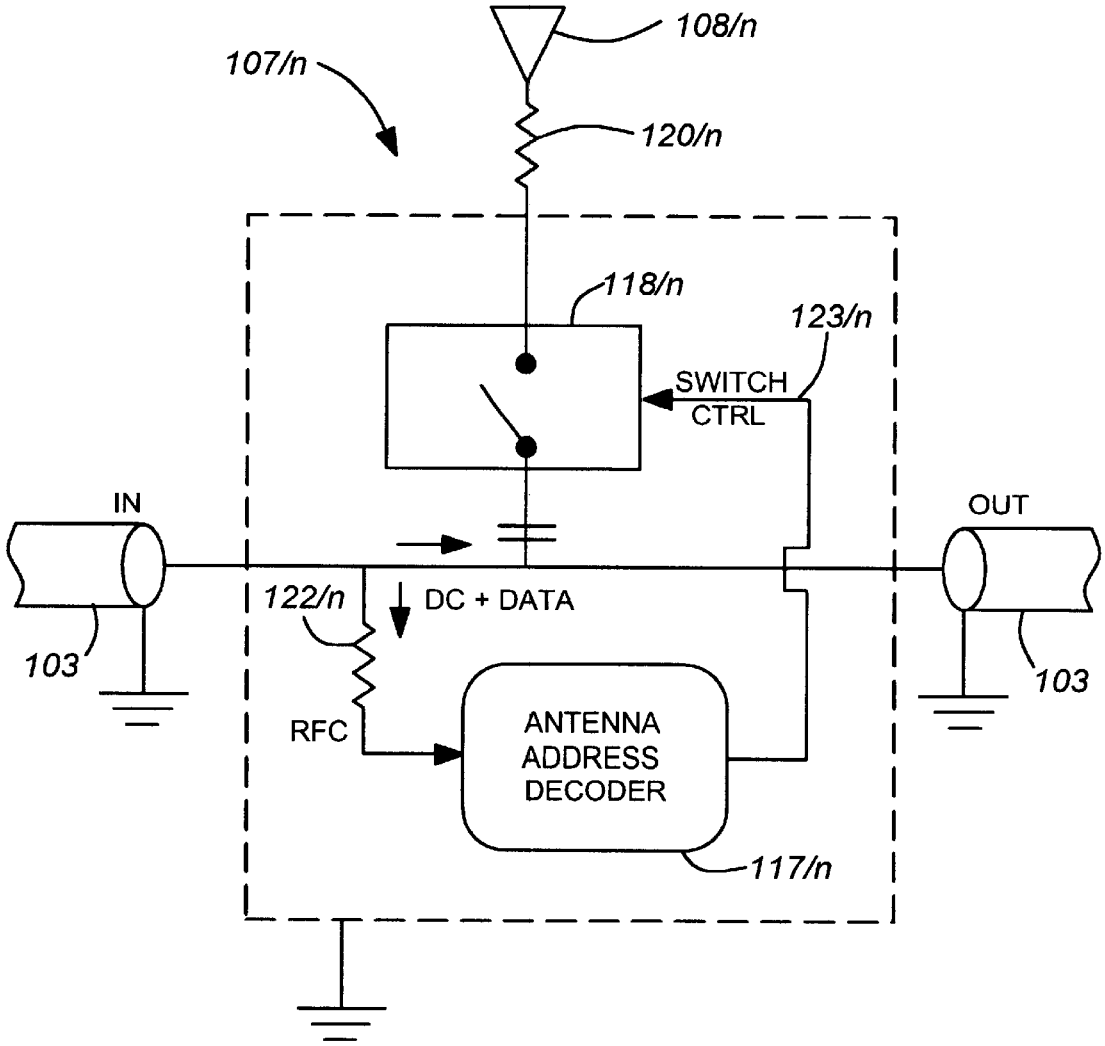
FIG. 4 is a block schematic diagram of a switching device coupling the antenna to a transmission line.

Referring to FIGS. 3 and 4, one of the patch antennas 108/n is shown mounted on a near side 114 of the fence 104 by a base 115 of an electrically insulating material. The transmission line 103 is mounted on a far side 116 of the fence 11. The switching device 107/n comprises an address decoder 117/n and a radio frequency switch 118/n. The switch 118/n is coupled via a capacitor 119/n to the transmission line 103 and via a decoupling resistance element 120/n to the patch antenna 108/n. Branches of the T-coupling are labelled IN and OUT as a matter of convenience but energy may traverse the coaxial transmission line 103 in either direction. The address decoder 117/n and switch 118/n are housed within an RF shielding enclosure/shroud 121/n. The switch 118/n may be either any electromechanical relay or a solid state device suitable for coupling RF energy to the antenna 108/n. The antenna address decoder 117/n is connected to the transmission line 103 via an RF blocking device 122/n to receive DC power and the address signals transmitted by the address transmitter 113 and controls operation of switch element 118/n, via a lead 123/n, in response to the receipt of the associated address control signal coupled from the transmission line 103. When the switch 118/n is closed, energy is exchanged between the transmission line 103 and the antenna 108/n via the blocking capacitor 119/n and the decoupling resistor 120/n.

Alternatively, the transmission line 103 and the switching devices 107/1 . . . 107/n may be concealed beneath the earth with short coaxial coupling lines extending between each of the switches 118/1 . . . 118/n and the associated one of the resistors 120/1 . . . 120/n, the latter each being located with the corresponding one of the antennas 108/1 . . . 108/n.

Figure 5:
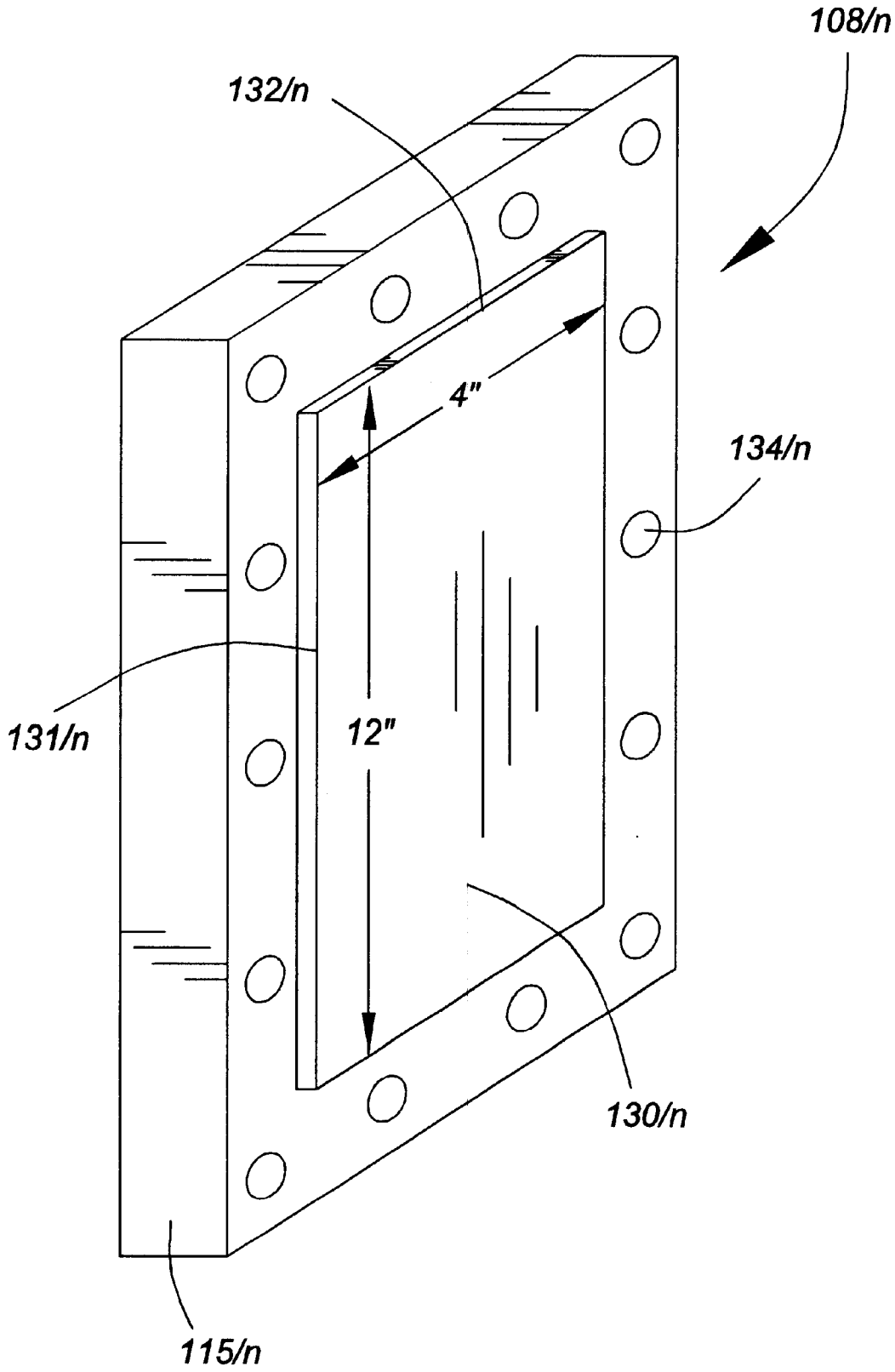
FIG. 5 is a perspective view of a patch antenna useful in the detection system illustrated in FIGS. 1 to 4.

Referring to FIG. 5, a suitable patch antenna 108/n comprises a conductive rectangular patch 130/n, typically having a length of 12" along one major side 131/n and a width of 4" along a minor side 132/n; in other words an oblong with a length to width ratio of about 3:1. The patch 130/n is mounted upon insulating substrate 115/n which is half an inch thick and is larger than the patch 130/n so as to provide a margin around the patch 130/n. Attachment holes 134/n in the margin facilitate easy fastening, perhaps by loops of cord, to the fence 104. As shown in FIG. 3, the resistor 120/n extends through an opening in the insulating layer 115/n and is connected at one end to the opposed surface of patch 130/n and at the other end to the tap. Alternatively, the insulating substrate 115/n can be any of several structures which will support the patch 130/n spaced and insulated from any conductive surface, such as when the fence 104 is made of metallic chain link or the antenna is connected to some other conductive structure.

Problems of false alarms and missed alarms resulting from movement of the fence 104 or other supporting structure were substantially mitigated during experimentation by selecting the value of the decoupling resistors 120/1 . . . 120/n to be between about 150 ohms and about 300 ohms. Eventually it was found that the illustrated embodiment, used with an operating frequency of about 80 MHz., was generally optimized with decoupling resistors 120/1 . . . 120/n of about 200 to 220 ohms. This gave an antenna gain of −25 dBd with noise immunity to tolerate lateral displacement of the fence fabric up to +/−¼ inch. This is not to suggest that these values are optimal for other operating wavelengths or for other forms of patch antennas, for example circular or triangular. Furthermore, although illustrated separately, the resistor 120/n may be included in the switching device 119/n or the latter may be so constructed as to dynamically provide a suitable value of coupling resistance.

Figure 6:
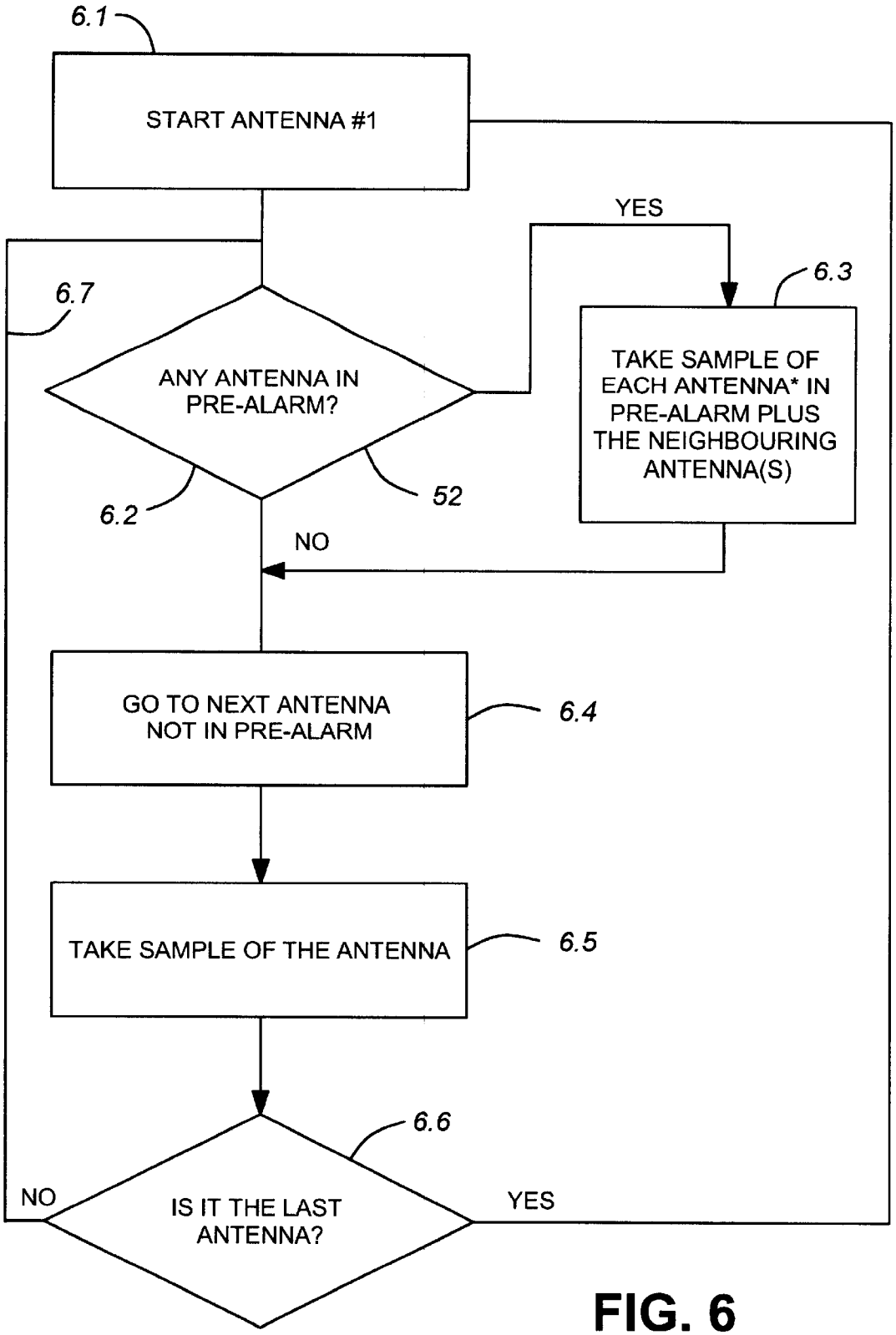
FIG. 6 is a flow chart diagram illustrating a method of operation of the system.

Operation of the system will now be described with reference to the flowchart shown in FIG. 6. In function step 6.1, the processor 111 initialises the system, e.g. counters, memory, and so on, and then begins the scanning process by scanning the first antenna 108/1. Such scanning entails the selection, energisation and received signal detection steps as previously described. In decision box 6.2, processor 111 accesses its memory (not shown) to determine whether or not there are any antennas in a "pre-alarm" state as a result of a previous scanning cycle detecting a perturbation in its signal. There will be no "pre-alarm" antennas because there were no previous scans, so, in steps 6.4 and 6.5 the processor 111 will select and scan the next antenna 108/2. Step 6.6 determines whether or not that is the last antenna in the array. Because it is not, loop 6.7 returns the processor to decision step 6.2, whereupon it checks again whether or not any antennas now are in the pre-alarm state. So long as none of the antennas are in the pre-alarm state, this loop will repeat steps 6.2 to 6.6 until all of the antennas have been scanned, whereupon decision step 6.6 and loop 6.8 cause the processor 111 to repeat the complete scanning cycle beginning with antenna 108/1. The scanning cycle will repeat until the scanning of at least one of the antennas detects a perturbation indicating that an intruder is present, i.e. a "pre-alarm" condition. When that happens, the processor 111 will record that antenna's identity in memory. During the next scanning cycle, decision step 6.2 will show that one or more antennas are in the pre-alarm state and, in function step 6.3, the processor 111 will cause all of those pre-alarm antennas to be scanned in turn. In practice, the processor may be programmed to scan not only each antenna that is in the pre-alarm state, but also its immediate neighbours Once these "pre-alarm" and neighbouring antennas have been scanned, the processor 111 will return to the main path of the flowchart shown in FIG. 6 and perform steps 6.4, 6.5 and 6.6 to scan the next antenna that is not in the pre-alarm condition. It will be appreciated that, each time the processor 111 completes the scanning of one of the antennas that are not in the "pre-alarm" state, it will scan all of the antennas that are in the pre-alarm condition again before it scans the next one of the antennas not in the pre-alarm state.

Preferably, the processor 111 processes the results of the scanning process statistically to determine a probability of an actual intrusion and raise an alarm contingent thereupon. If the pre-alarm indication for a particular antenna turns out to be only a random event, as determined, for example, because neither of its immediate neighbours also registers a pre-alarm, the processor 111 will not raise an alarm but rather will delete the record from memory and continue the scanning process with that antenna treated as a "normal" antenna. This procedure is useful to increase the sensitivity of the system while avoiding frequent false alarms which might otherwise reduce the response of attendant personnel.

Various modifications to the above-described embodiment are envisaged. For example, the scanning routine described with reference to FIG. 6 could be arranged to scan the "pre-alarm" antennas alternately with the antennas not indicating a "pre-alarm".

It is also envisaged that the number of "pre-alarm" antennas selected for scanning could be limited to a predetermined maximum in order to avoid reducing their sampling rate to an unacceptable level.

Although, in the above-described detection system, the antennas transmit and the leaky cable receives, it will be appreciated that antenna reciprocity applies, meaning that the receiver and the transmitter are interchangeable.

It should be noted that, because the antennas are isolated electrically from the leaky cable, mechanical continuity of the coaxial cable 103 can be maintained, which affords a high level of reliability.

Advantageously, embodiments of the invention allow time- multiplexed scanning of as many antennas (sub-zones) as possible while maintaining a sampling rate per antenna high enough to obtain a reasonable resolution of the intrusion profile signature.

For example, to illustrate the advantages of time multiplexing, the following practical assumptions may be made:

a) minimum electronic sampling rate:
2 millisec/sample; and
b) typical sample per intrusion profile:
5 samples/intrusion;
for a minimum sampling rate per intrusion of:
2×5=10 millisec/intrusion, or 0.01 sec/int.
c) maximum intruder running speed:
8 meters/second (18 miles/hour); and
d) typical width of the detection envelope:
2 meters (6 to 7 feet);
for a minimum intrusion time of:
2/8=0.25 second Therefore, the over-sampling ratio for a running intrusion (worst case scenario) is: 0.25/0.01=25

This means that a maximum of 25 sub-zones can be time multiplexed without sacrificing the probability of detection, even for a fast running intruder.

As a practical example, a typical correctional facility perimeter might comprise a dual fence spaced apart by 20 ft and 12 ft high, with 25 antennas spaced apart by 50 ft, for a total perimeter of 1,250 ft (350 m) maximum per electronic module with sub-zone resolution of 50 ft.

The concept of a variable sampling rate further improves detection capability. In the absence of an intrusion (target), the sampling rate per antenna may be reduced, which increases the over-sampling ratio, which typically increases the number of antennas to "time-multiplex" per electronic module by a factor of ten (10). Detection of a pre-alarm condition may be determined according to a pre-alarm threshold, that is normally set midway between the alarm threshold and background noise. Under quiet operation (i.e. in the absence of an intrusion), each antenna is switched at a lower rate on an even basis. But when one antenna response exceeds the pre-alarm threshold, more time is spent sampling that antenna. This technique presents a variable sampling rate condition for no intrusion, first intrusion, second intrusion, etc., which means that the probability of detecting a single intrusion is higher than detecting a double intrusion and so on. This compromise will usually be acceptable to increase the number of sub-zones per single electronic module, though the acceptance of such a compromise depends on the threat level and the applications.

Finally, an even finer resolution for the intrusion location may be obtained by comparing intrusion alarm conditions between adjacent antennas/sub-zones. This technique allows a resolution accuracy equal to one third of the antenna spacing to be achieved, for a final location resolution of 50 ft/3=17 ft (5 m).

Advantageously, each antenna/sub-zone may have an individual alarm threshold, which means that the noise of a difficult sub-zone is not integrated with the entire perimeter noise. Also any sub-zone can be temporarily disabled to allow authorized personnel to cross the perimeter without shutting down the entire perimeter.

The increased intrusion resolution allows a surveillance video camera, where applicable, to be pre-set to a finer resolution for more efficient video assessment.

A wide range of miniature antennas can be used so long as the loaded impedance is high in reference to the coaxial cable impedance. A high impedance, like a test probe, extracts a very small portion of the RF signals that propagate within the coaxial cable in order to minimize the cable loss along the array of antennas. Mini-whip antennas, say 10 inches long, or other small, non-directional antennas, may be used instead of patch antennas.

It is also envisaged that, where the antenna cable is deployed in an elevated location, such as along a fence or on the roof of a building, one or more surveillance cameras could be installed at intervals along its length. The or each camera could be embedded into a respective one of the antennas, preferably so that it is hidden. Video signals from the cameras to a monitoring station could be transmitted via the coaxial antenna cable. The power supply to the cameras could be via the coaxial cable.

An advantage of detection systems embodying the present invention is that they maintain a uniform RF signal strength all along the secured perimeter and allow the intrusion/crossing location to be obtained by simply activating only one antenna at a time, i.e., by time multiplexing the antennas. Therefore, each individual antenna forms its own detection zone.

What is claimed is:

1. A detection system, for detecting intruders moving in the vicinity of a defined path, comprising a distributed antenna extending along the path and an array of discrete antennas extending alongside the distributed antenna and within a predetermined distance therefrom, the antennas being spaced apart from each other and the distributed antenna and defining a plurality of detection zones, a radio frequency transmitter connected to one of the distributed antenna and the array of discrete antennas, and a complementary receiver connected to the other of the distributed antenna and the array of discrete antennas, switching means for connecting the antennas individually and selectively to the transmission line, and control means for controlling the transmitter, receiver and switching means to select each of the antennas in said array in a sequence, exchange radio frequency energy via the distributed antenna and each selected antenna, analyze the energy received from each selected one of the array of antennas so as to detect indications of an intruder moving adjacent said path and adjacent that particular antenna, and repeat said selection sequence.

2. Apparatus according to claim 1, wherein the control means is operable such that, in the event that, during an instant selection sequence a said indication is detected in the received energy from a group comprising at least one of the antennas, the control means records in memory an identifier for each antenna in said group and, in subsequent selection sequences, selects the group of antennas more frequently than antennas whose identities are not recorded in said memory.

3. Apparatus according to claim 2, wherein the control means is operable to select the entire said group of antennas alternately with individual ones of the antennas whose identities are not recorded in memory.

4. Apparatus according to claim 2, wherein the control means is operable to select individual ones of the antennas in said group alternately with individual ones of the antennas whose identities are not recorded in said memory.

5. Apparatus according to claim 2, wherein the control means is operable to select more frequently not only each antenna for which a said indication was detected, but also at least one antenna that is an immediate neighbour thereof.

6. Apparatus according to claim 1, wherein the control means comprises means for transmitting antenna addresses onto the transmission line and the switching means comprises a plurality of switching devices each comprising an address decoder coupled to the transmission line for detecting the address of the associated antenna and a radio frequency switch controlled by the address decoder to connect the associated antenna to the transmission line upon detection of said address.

7. Apparatus according to claim 1, wherein the radio frequency energy has a wavelength not much less than about ten times the longest dimension of any of said antennas in said array.

8. Apparatus according to claim 7, wherein each of the array of antennas comprises a patch antenna having a longest planar dimension of not much more than about 15 per cent of a wave length of said energy.

9. Apparatus according to claim 1, wherein the antennas are each coupled to the transmission line by a respective one of a corresponding plurality of resistance means.

10. Apparatus according to claim 9, wherein the resistance means has a resistance value of between about 150 and 300 ohms.

11. Apparatus according to claim 1, wherein each of the array of antennas is rectangular, having a longest planar dimension along any one edge of a major plane of about 10 per cent of a wavelength of said energy and having a length to width ratio of about 3:1 in said major plane, and is coupled to the transmission line by a resistance means having a resistance of about 200 ohms.

12. An intrusion detection apparatus comprising:

a distributed antenna for defining a path near which detection of an intruder is desired;

a plurality of small antennas for being spaced apart from each other and along a line spaced adjacent the distributed antenna;

a transmission line having taps, each tap for being coupled to a respective one of said plurality of spaced small antennas;

switching means for selectively coupling each of the small antennas individually to the transmission line;

transmitter means for propagating a continuous wave signal along one of the distributed antenna and the transmission line;

receiver means for receiving any of said continuous wave signal received by the other of the distributed antenna and the transmission line;

means for controlling the switching means and either or both of the receiver means to select each antenna in turn to couple the continuous wave signal between the transmission line and the distributed antenna, detect the corresponding received signal, and determine from the received signal whether or not an intruder is present.

13. A method of operating an intrusion detection system having a distributed antenna extending along a path to be monitored and an array of discrete antennas extending alongside the distributed antenna and within a predetermined distance therefrom, the method comprising the steps of:

exchanging radio frequency energy several times between the distributed antenna and selected ones of the array of discrete antennas, in turn, analyzing such received energy exchanged for each selected antenna to detect an indication of an intruder moving near the path and adjacent that antenna.

14. A method for operating an intrusion detection system according to claim 13, wherein, in the event that said indication is detected, the method further comprises the step of recording the identity of that antenna in memory and, in subsequent selection sequences, selecting those antennas whose identities are recorded in memory more frequently than those antennas whose identities are not recorded.

15. A method for operating an intrusion detection system having a plurality of zones defined by a corresponding plurality of small antennas coupled to a transmission line and a distributed antenna extending alongside the small antennas, each of said small antennas having a unique address for being addressably enabled for coupling between the transmission line and the distributed antenna energy supplied by a source of continuous wave energy, the method comprising the steps of:

enabling said small antennas in a sequence, one after another;

making a record of a characteristic of the energy initially coupled via each small antenna and thereafter repeatedly enabling each of the small antennas in the sequence;

comparing the characteristic of the instantly coupled energy of each small antenna, as it is enabled in the sequence, with the corresponding record for that zone; and where the comparison reveals a difference between the instant and recorded characteristics in excess of a predetermined amount, indicating the instant antenna and associated zone to be in a potential alarm condition indicative of an intrusion.

* * * * *